US006267420B1

(12) United States Patent
Miyagawa

(10) Patent No.: US 6,267,420 B1
(45) Date of Patent: Jul. 31, 2001

(54) LATCH MECHANISM FOR OPEN-CLOSE MEMBER OF A VEHICLE

(75) Inventor: Masazumi Miyagawa, Frankfort, KY (US)

(73) Assignee: Ohi Seisakusho Co., Ltd., Yokohama (JP)

( * ) Notice: Subject to any disclaimer, the term of this patent is extended or adjusted under 35 U.S.C. 154(b) by 0 days.

(21) Appl. No.: 09/409,426

(22) Filed: Sep. 30, 1999

(51) Int. Cl.[7] ..... E05C 3/06
(52) U.S. Cl. ..... 292/216; 292/DIG. 43
(58) Field of Search ..... 292/216, DIG. 43, 292/DIG. 23, 336.3

(56) References Cited

U.S. PATENT DOCUMENTS

| | | | | |
|---|---|---|---|---|
| 4,948,184 | * | 8/1990 | Weyerstall | 292/216 |
| 5,074,603 | * | 12/1991 | Brackmann | 292/216 |
| 5,137,311 | * | 8/1992 | Brackmann | 292/216 |
| 5,445,326 | | 8/1995 | Ferro et al. | 292/336 |
| 5,769,468 | * | 6/1998 | Armbruster | 292/201 |
| 5,868,444 | * | 2/1999 | Brackmann | 292/210 |
| 5,897,148 | * | 4/1999 | Arabia | 292/216 |
| 5,979,951 | * | 11/1999 | Shimura | 292/216 |
| 6,109,671 | * | 8/2000 | Roncin | 292/216 |

* cited by examiner

*Primary Examiner*—Gary W. Estremsky
(74) *Attorney, Agent, or Firm*—Foley & Lardner

(57) ABSTRACT

In a latch mechanism of an open-close member for a vehicle, a latch plate to be inlaid on a striker when a lid is closed and a detent lever for holding the latch plate in latched condition are pivotally supported by a base plate whose lower portion branches out in a forked shape abutting against the striker. An open lever for separating the latch plate from the striker by abutting against the detent lever is provided. Further, provided are a stopper lever pivotally supported by the base plate and used for controlling the pivoting of the detent lever toward the latch plate by abutting against the upper end of the detent lever, and a spring for urging and pivoting the stopper lever toward the detent lever at all times. Further, a reset lever rotatably supported by the base plate, with one end mating with the stopper lever and other end having a lock-releasing knob, is pivoted through the operating of the knob between two positions including a first position where the pivoting of the detent lever is controlled by the stopper lever and a second position where control of the pivoting of the detent lever is released by the stopper lever.

8 Claims, 6 Drawing Sheets

LATCH MECHANISM FOR OPEN-CLOSE MEMBER OF A VEHICLE

BACKGROUND OF THE INVENTION

1. Field of the Invention

This invention relates to a latch mechanism for an open-close member of a vehicle, and more particularly to a latch mechanism having the function of keeping an open-close member such as a trunk lid from being locked only by performing the operation of closing the open-close member.

2. Description of the Related Art

Trunk lids of such as passenger cars are held in unlocked condition after the lid is caused to be slightly opened by operating a lock releasing knob from within the car or inserting a key into the keyhole formed in the lid and turning the key so as to disengage the latch portion of a latch mechanism from a striker. Then the lid is opened wide manually from the above condition and while the lid is left open, baggage can be taken in and out of the trunk room.

When the lid is shut, moreover, the lid is automatically locked by closing the lid manually with great force so as to engage the latch portion with the striker.

However, the following problems would arise from the aforementioned mechanism:

One of the problems is that the operation of closing the lid is often performed unconsciously and whenever the lid is closed unnecessarily, the key or knob operation will be needed to open the lid again on all such occasions, which is very troublesome. If a driver closes the lid while the key is left in the trunk room with all of the car doors locked, the driver will be unable to get into the vehicle without a spare key.

Another problem refers to a case where a child staying inside the trunk room manages to close the lid from inside in such a state that its parents are entirely unaware of the happening.

In that case, the fact that the locking device is usually impossible to unlock from inside of the trunk room could lead to a serious accident.

In this respect, according to U.S. Pat. No. 5,445,326, for example, a mechanism for making a locking device unlockable on the inside of a trunk room is added so that when any person is locked into the trunk room by mistake, the locking device can be unlocked from inside of the trunk room by pulling a lock releasing string attached to the mechanism, whereby the person is allowed to escape from the trunk room.

Notwithstanding, the aforementioned arrangement is intended not for a case where the key is left inside the trunk room but for a case where a person has been locked into the trunk room.

SUMMARY OF THE INVENTION

An object of the present invention is to provide a latch mechanism of an open-close member for a vehicle, which mechanism is not locked only through the operation of closing a lid and capable of causing the lid to be closed and locked by the addition of a reset operation.

Another object of the present invention is to provide a latch mechanism for an open-close member of a vehicle, which mechanism permits selecting one of two ways including (i) locking the mechanism only through the operation of closing a lid and (ii) locking the mechanism by adding a reset operation to the operation of closing the lid.

A latch mechanism of an open-close member for a vehicle to which the invention is applied comprises: a base plate whose lower portion branches out into a forked shape abutting against a striker, a latch plate that is pivotally supported by one branch surface of the base plate and has the striker fitted in when a lid is closed, a detent lever that is pivotally supported by the other branch surface and holds the latch plate in latched condition, and an open lever for separating the latch plate from the striker by abutting against the detent lever.

According to the present invention, the latch mechanism is provided with a stopper lever pivotally supported by the base plate and used for controlling the pivoting of the detent lever toward the latch plate by abutting against the upper end of the detent lever. The stopper lever is urged and pivoted by an elastic member toward the detent lever at all times. A reset lever pivotably supported by the base plate is also provided, one end of the reset lever mating with the stopper lever, the other end thereof having a lock-releasing knob. The reset lever is pivoted through the operation of the knob between two position including (i) one position where the pivoting of the detent lever is controlled by the stopper lever and (ii) the other position where the control of the pivoting thereof is released.

According to the present invention, the lid will never be locked in the closed condition without operating the reset lever.

It is preferred to provide the latch plate with a portion for returning the reset lever to the pivotal control position by impinging on the reset lever when the lid is closed in the released condition of the pivotal control.

With the construction thus arranged, the reset lever is automatically returned to the pivotal control position simultaneously with the closed-lid locking operation and the lid will never be locked in the closed condition without operating the reset lever when the lid is opened next.

Moreover, it is also preferred to provide a cancel lever that is pivotally supported by the base plate and selectively holds the stopper lever through the pivotal operation in an abutment position or a non-abutment position relative to the detent lever.

With this construction, one of the two modes including (i) the aforementioned unlocking operation at the time of closing the lid and (ii) the conventional locking operation can be selected by the operation of the cancel lever.

DETAILED DESCRIPTION OF THE PREFERRED EMBODIMENTS

A detailed description of the preferred embodiment of the invention will now be given with reference to the appended drawings.

Figure 1:
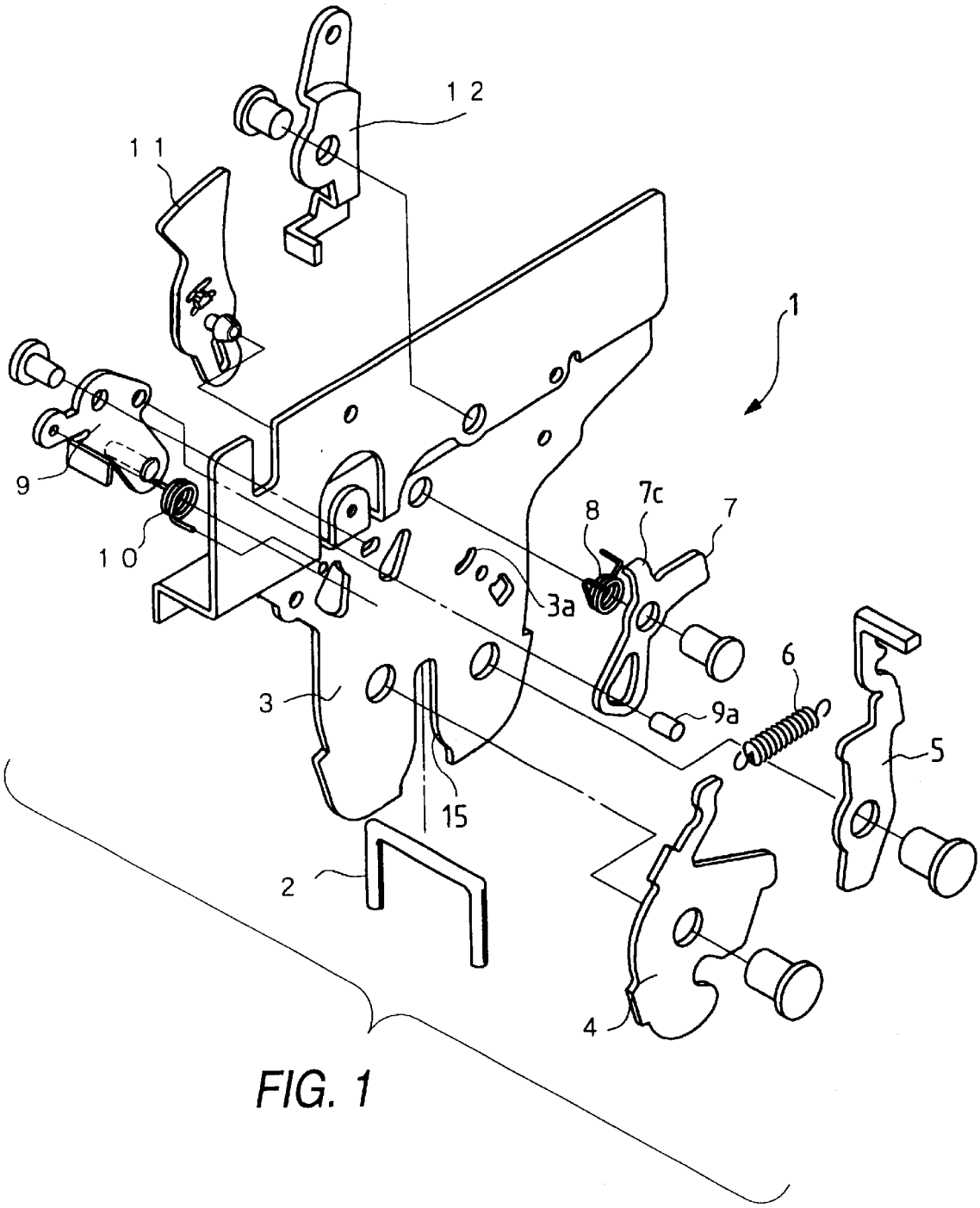
FIG. 1 is an exploded perspective view showing an arrangement of parts in a latch mechanism according to an embodiment of the invention.
Figure 2:
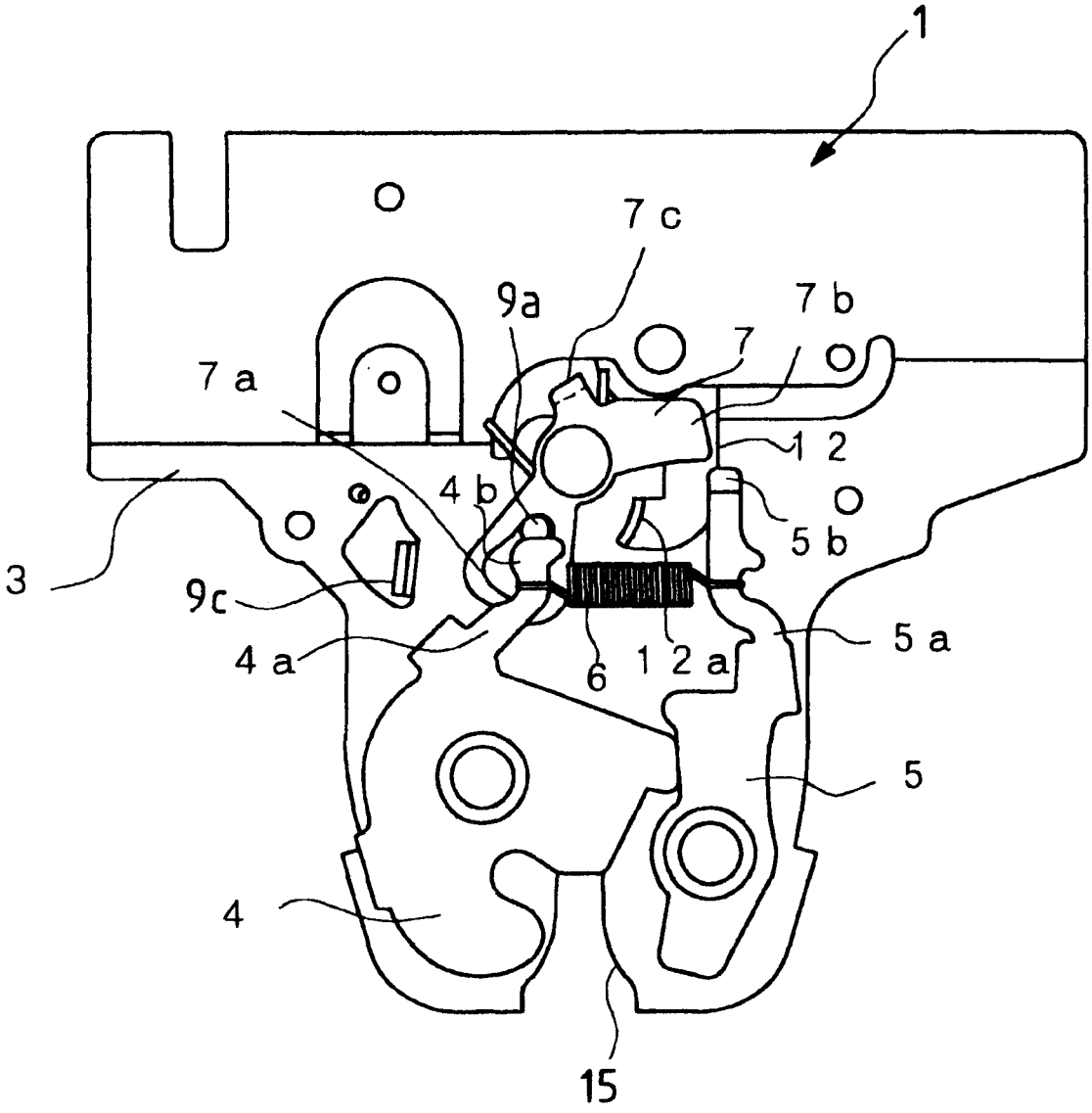
FIG. 2 is an elevational view of the latch mechanism.
Figure 3:
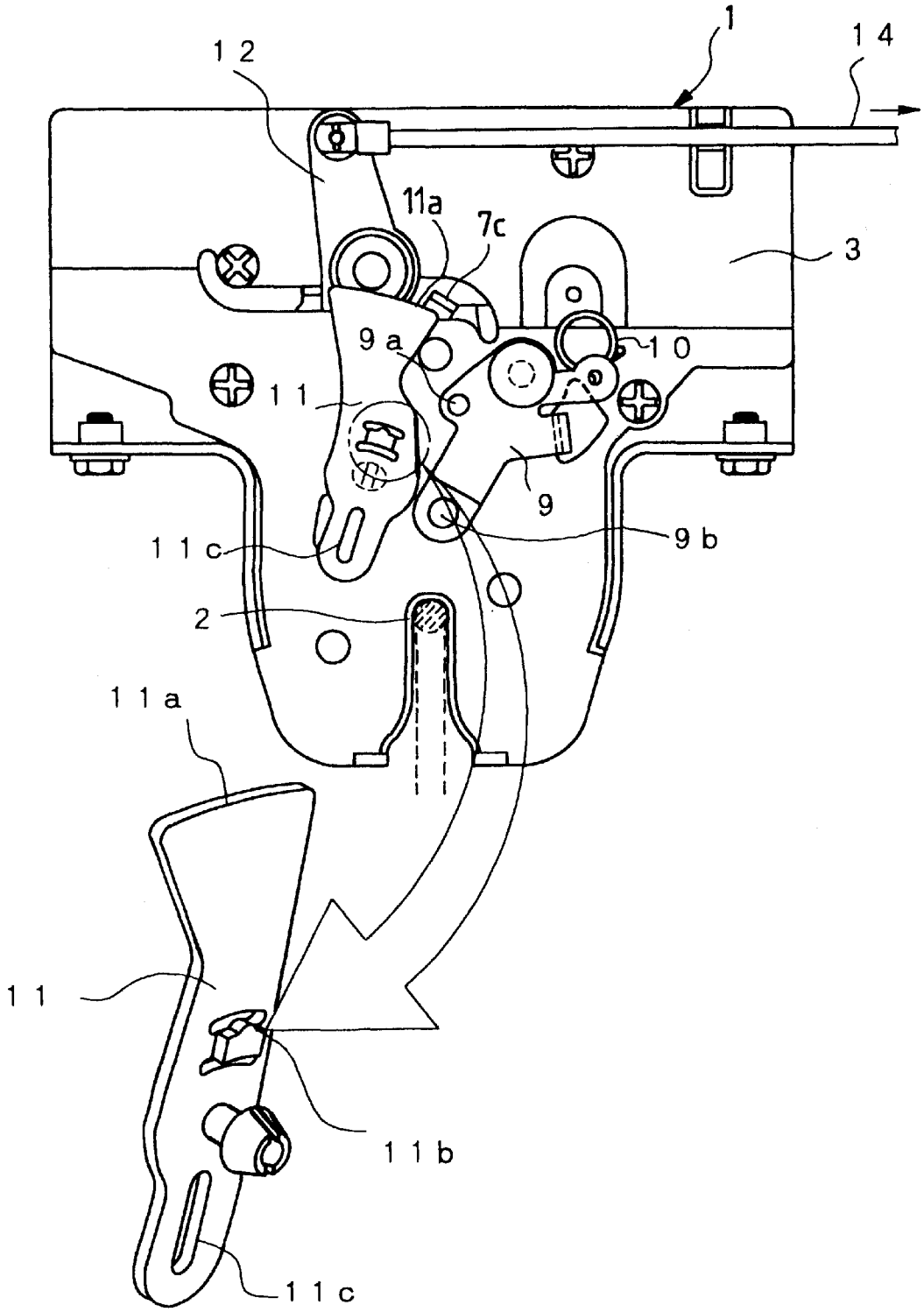
FIG. 3 is a rear view of the latch mechanism including a partial enlarged view thereof.

FIGS. 1 to 3 show a latch mechanism 1 according to an embodiment of the present invention, and FIGS. 4 and 5 are diagrams showing the operation thereof. This latch mechanism 1 mainly comprises the following members:

- a base plate 3 fixed to the open-close end of a lid in opposition to a striker 2 secured to the vehicle body side, the base plate 3 having a forked lower portion and having a striker introducing groove 15;
- a latch plate 4 pivotably mounted on one of the forked branch surfaces in the front of the base plate 3 with a pin as a fulcrum and disengageably inlayed onto the striker 2;
- a detent lever 5 pivotably mounted on the other forked branch surface in the front of the base plate 3 with a pin as a fulcrum and used for maintaining the latch plate 4 in locked condition when the lid is closed;
- a tension spring 6 stretched between the upper portion of the latch plate 4 and that of the detent lever 5 and used for urging and pivoting both of them in opposite directions;
- a stopper lever 7 for holding the detent lever 5 in an unlocked condition when the lid is opened, and a torsion spring 8 pivotably mounted coaxially with and in the rear side of the stopper lever 7 and used for urging and pivoting the stopper lever 7 clockwise at all times;
- a reset lever 9 pivotably mounted on the back of the base plate 3 with a pin as a fulcrum and interlocked with the stopper lever 7 so as to reset the stopper lever 7 from a lockable condition from the unlocked condition when the lid is opened, and a turnover spring 10 for urging and pivoting the reset lever 9 in one direction.

The latch mechanism 1 also includes a cancel lever 11 pivotably mounted on the back of the base plate 3 and used for selecting either locked or unlocked condition relative to the striker 2 when the lid is closed after it has been opened.

The latch mechanism 1 further includes an open lever 12 pivotably mounted on the back of the base plate 3 with a pin as a fulcrum and interlocked with a locking mechanism so as to release the lock when the lid is closed.

Only the cancel lever 11 among the aforementioned members is plastic and the rest of them are formed by press-molding metal such as steel.

A description of each of the aforementioned members, member-to-member coupling and operation will now be given. The function of the cancel lever 11 but its relation to other members will be described later.

The base plate 3 is provided with holes for use in supporting the pins of the respective members and a plurality of windows for use in connecting the members.

Further, the upper portion of the base plate 3 is formed into an L-shaped stepped portion, and the lower-end retaining portion 12*a* of the open lever 12 projects through the gap formed therebetween, the leading end of the retaining portion 12*a* facing the upper end of the detent lever 5.

A pin 9*a* and a flange 9*c* are provided on the reset lever 9. The pin 9*a* and the flange 9*c* are projected through the windows of the base plate 3. Moreover, an operating knob 9*b* is projected toward the back side of the base plate 3.

The pin 9*a* is fitted in a cam hole 7*a* made at a rocking end on one side of the stopper lever 7. At the other side of the stopper lever 7, a retaining pawl 7*b* and a retaining pawl 7*c* are formed. The retaining pawl 7*b* mates with a holding portion 5*b* formed at an upper end of the detent lever 5. The retaining pawl 7*c* projects backward and mates with the cancel lever 11.

An arm 4*a* by which the spring 6 is retained is formed in the upper portion of the latch plate 4, and a contact portion 4*b* is formed at the upper end of the arm 4*a*.

An arm 5*a* by which the spring 6 is retained is also formed in the upper portion of the detent lever 5, and the holding portion 5*b* projecting forward is formed at the upper end of the arm 5*a* so that it can engage with the retaining pawl 7*b* of the stopper lever 7 as aforementioned.

The operation of the arrangement above will subsequently be described.

Figure 4A:
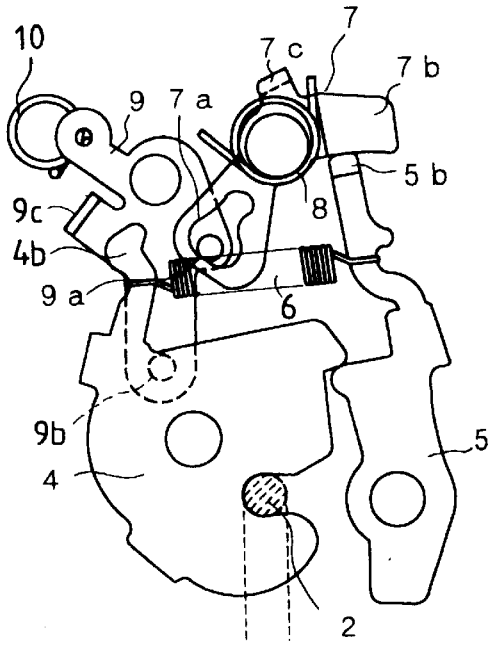
FIGS. 4A to 4D are diagrams illustrating the operation thereof.

As shown in FIG. 4A, a locking mode in the aforementioned latch mechanism in the closed condition of the lid is basically the same as before.

The lower center of the base plate 3 straddles the rodlike upper end of the striker 2 as illustrated. Further, the striker 2 is introduced into the striker introducing groove 15 of the base plate 3.

Then the striker 2 forces up the latch plate 4 and when the latch plate 4 is pivoted counterclockwise, its collar holds the lower portion of the striker 2 in its mouth, whereby the striker 2 is held and locked between the base plate 3 and the latch plate 4. Moreover, the detent lever 5 is tilted counterclockwise by the spring pressure of the spring 6 in this state and when its upper shoulder portion steps under an overhang portion in the shoulder portion of the latch plate 4, the movement of the latch plate 4 is controlled, so that the locked condition is maintained.

Figure 4B:
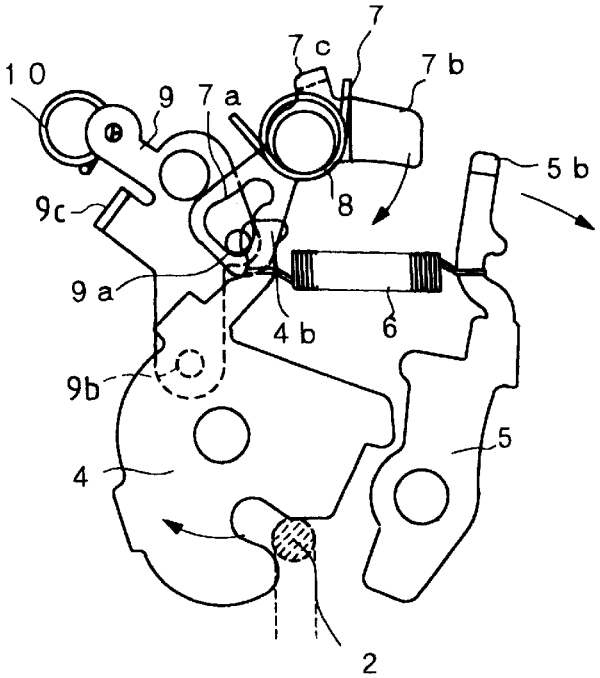
Figure 4C:
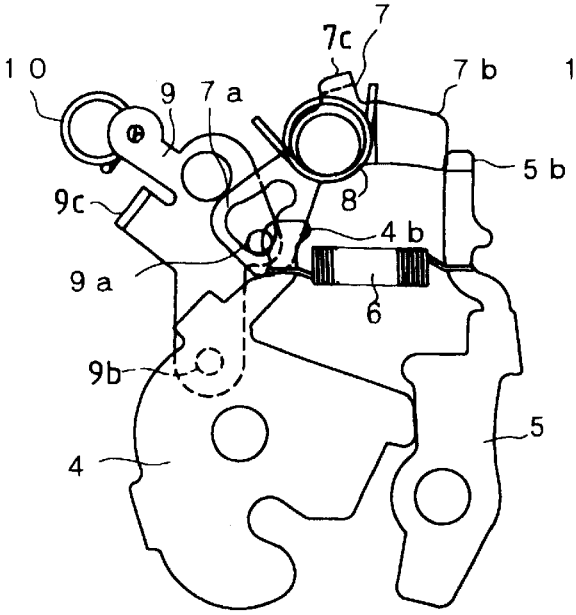

In order to cancel that locked condition, the lower retaining portion 12*a* of the open lever 12 is caused to mate with and push the upper end of the detent lever 5 clockwise by pivoting the open lever 12 counterclockwise. Consequently, the collar of the latch plate 4 is unhooked from the striker 2 and the unlocked condition is established as shown in FIG. 4B.

In this embodiment, it has been arranged that the upper end of the open lever 12 is coupled to a rod 14 for opening the lid as shown in FIG. 3 and that the open lever 12 is pivoted by moving the rod 14 in direction of arrow under remote control.

The aforementioned locking-unlocking operation is substantially similar to what is performed in the latch mechanism heretofore in general use. In the conventional latch mechanism, however, the collar of the latch plate 4 is returned to the original position shown in FIG. 4A in such a state that the collar thereof has not hold the striker 2 in its mouth. Therefore, the upper end of the striker 2 is caused to contact the underside of the collar of the latch plate 4 by closing the lid from the above state and the latch plate 4 is pushed clockwise against the spring pressure of the spring 6. Then the locked condition shown in FIG. 4A is restored when the collar holds the striker 2 in its mouth again.

On the contrary, the present invention features that the lid is maintained in the unlocked condition while it is kept open. When the unlocking operation in FIG. 4B is performed, the stopper lever 7 is pivoted clockwise by the spring pressure as shown by the arrow. As a result, the retaining pawl 7*b* abuts against the holding portion 5*b* of the detent lever 5 so as to block the returning of the detent lever 5 toward the latch plate 4.

Even though the lid is closed in the situation above, the latch mechanism is held in the unlocked condition and the lid is returned to the open condition because of urging pressure in the direction of opening the lid (not shown) whenever it is attempted to close the lid, so that the lid is repeatedly placed in floating condition.

Figure 4D:
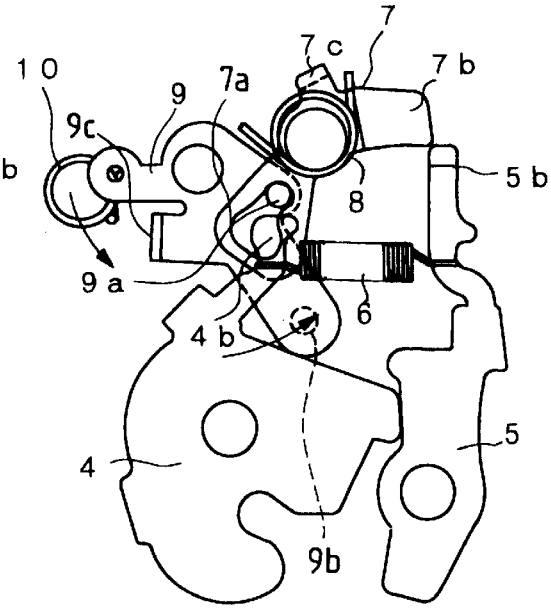

In order to close the lid and make it lockable out of the above condition, the operating knob 9*b* projecting at the leading end of the reset lever 9 is manually pressed down counterclockwise as shown in FIG. 4D. Then pin 9*a* moves up along the cam hole 7*a,* and the stopper lever 7 is pivoted counterclockwise against the spring pressure of the torsion spring 8.

Consequently, the detent lever 5 is released from the spring-back restriction toward the latch plate 4. Moreover, because of the relation between the pin 9*a* and the cam hole 7*a* as well as the two position stability of the turnover spring 10, the condition of the stopper lever 7 is maintained. The reason is as follows:

In such a state shown in FIG. 4D that the detent lever 5 is released from the restriction toward the latch plate 4, clockwise rotational force of the stopper lever 7 caused by the torsion spring 8 directs to the rotation center of the reset lever 9 via the cam hole 7*a* and the pin 9*a.* Accordingly, rotational force to rotate the reset lever 9 is not caused, and the stopper lever 7 is maintained at the position shown in FIG. 4D. The latch mechanism 1 in this state becomes usable similarly as before accordingly.

When the lid is closed after the reset operation, the striker 2 abuts against the lower end of the latch plate 4, and the locking operation is performed similarly as described by pivoting the latch plate 4.

Simultaneously, the contact portion 4*b* of the latch plate 4 impinges on the flange 9*c* of the reset lever 9, whereby the reset lever 9 returns to the original position shown in FIG. 4A while it keeps pressing down the pin 9*a.*

Although the projected end of the operating knob 9*b* of the reset lever 9 remains simply uncovered as illustrated, it may be desirable projecting that end from the surface of a housing (not shown) for covering the latch mechanism, fitting a plastic knob cover, for example, to the projected end and simultaneously attaching a label or print displaying lock-on and lock-off operations.

The function of the cancel lever 11 and its relation to other members will subsequently be described with reference particularly to FIG. 3, FIGS. 5A and 5B. The cancel lever 11 includes a fan-shaped cam 11*a* mating with the retaining pawl 7*c* of the stopper lever 7, the cam 11*a* being formed on the top surface of the cancel lever 11. A click stopper 11*b* for pivoting the cancel lever 11 in a clicking fashion is projected from the back thereof as shown in the enlarged view of FIG. 3 in particular and brought into contact with a retaining window 3*a* of the base plate 3. Further, a groove 11*c* that can be pivoted by a coin, a minus-driver or the like is formed at the rocking end on the lower portion of the cancel lever 11.

Figure 5A:
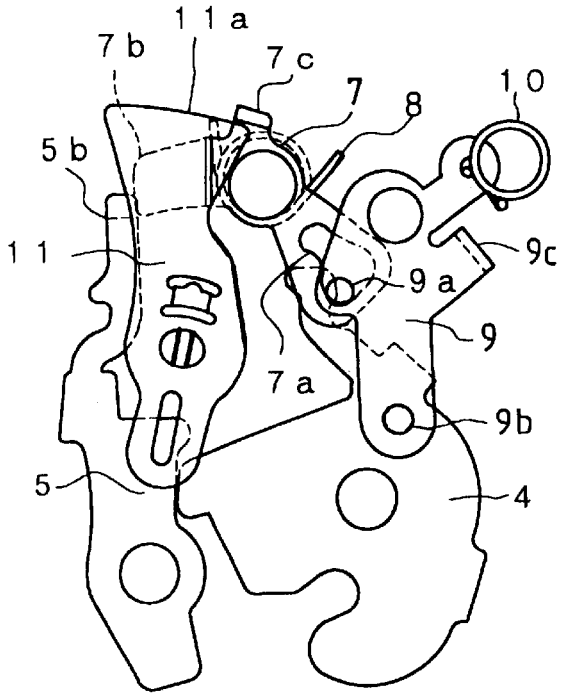
FIGS. 5A and 5B are diagrams illustrating the operation of a cancel lever.

When the cancel lever 11 is pivoted to the unlocking position shown in FIG. 5A with the pin as a basic point, the retaining pawl 7*c* of the stopper lever 7 comes off the face of the cam 11*a,* so that the unlocking function is performed at the time of closing the lid.

Figure 5B:
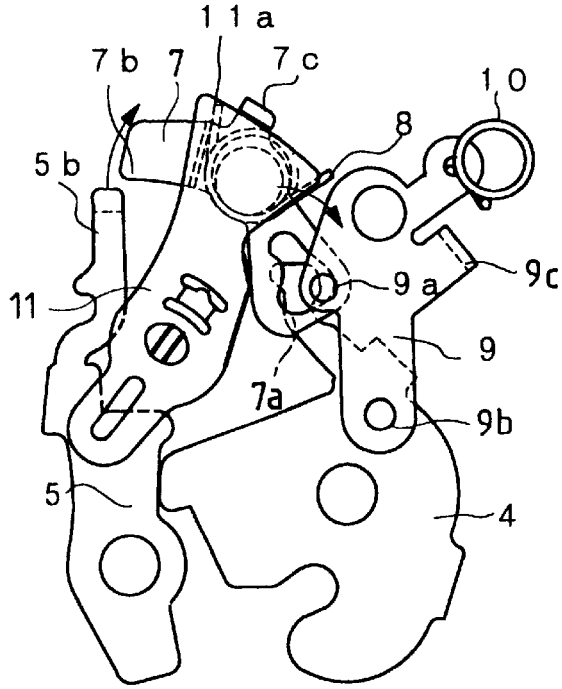

Pivoting the cancel lever 11 to the locking position from the above state makes the retaining pawl 7*c* of the stopper lever 7 mate with the face of the cam 11*a* as shown in FIG. 5B, thus causing the retaining pawl 7*c* thereof to be pivoted in the same direction, so that the cancel lever 11 retains the state of being separated from the detent lever 5.

Thus, the unlocking function at the time of closing the lid is canceled and the locking operation substantially similar to what is performed in the latch mechanism heretofore in general use is performed.

The aforementioned switching function is dependent on the user designation and as the switching operation is not performed regularly, the switching arrangement is set in a less conspicuous position. In other words, the switching operation is to be performed manually by a dealer or a user with a coil or a minus-driver.

Figure 6:
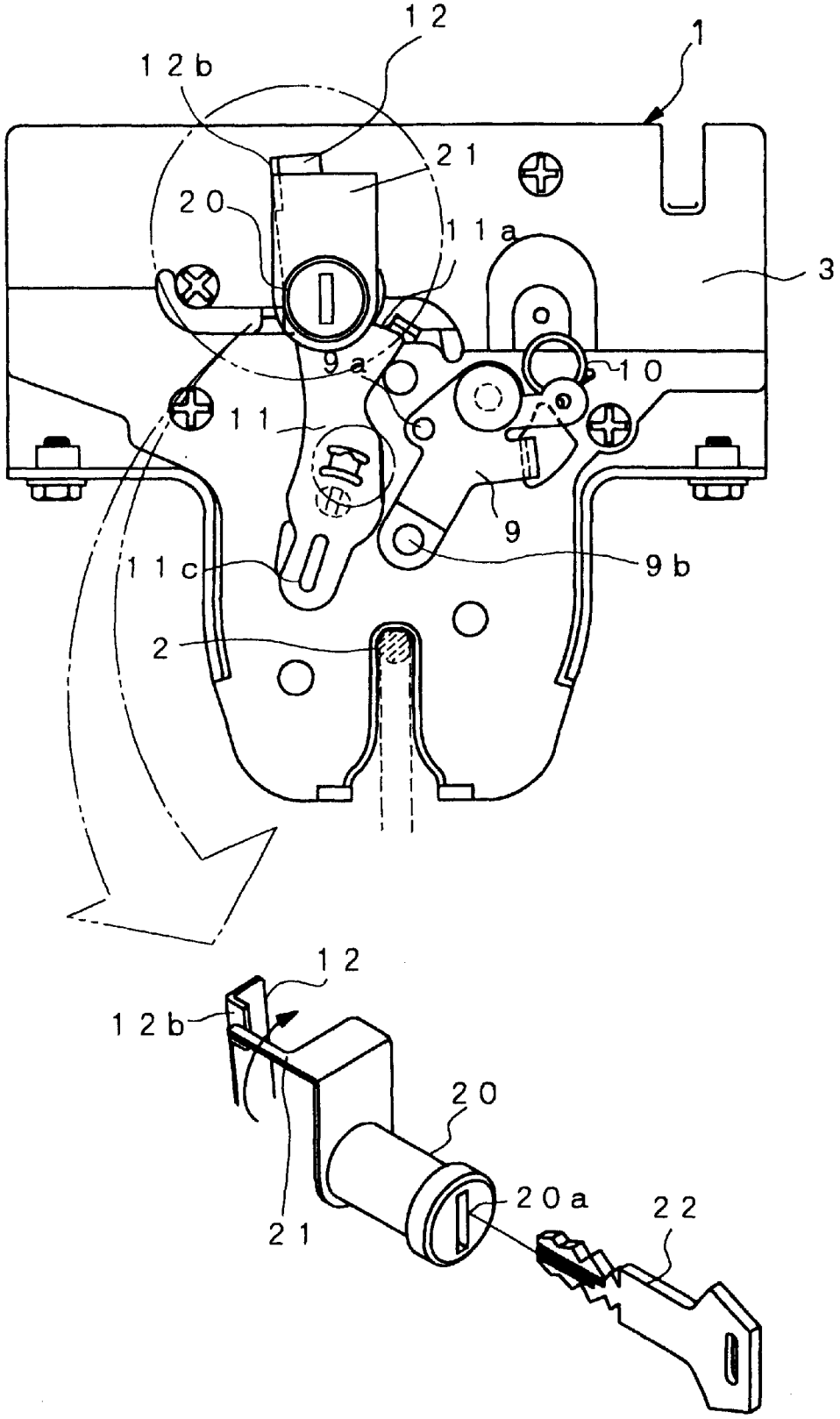
FIG. 6 is a rear view of the latch mechanism according to another embodiment of the invention, which has a direct locking system.

FIG. 6 shows another embodiment of the invention adapted for a direct locking system, wherein like reference characters are given to like component parts with the omission of the description thereof, whereupon only those different therefrom are denoted by different reference characters for description.

As shown in FIG. 6, a tab 12*b* is projected from the side of the arm of the open lever 12. On the other hand, a cylinder lock 20 is mounted on the back of the lid, and a pointed arm 21 is mated with the tab 12*b.* When a key is inserted into a keyhole 20*a* opened in the rear of the cylinder lock 20 and turned, the open lever 12 is pivoted clockwise, whereby the unlocked condition is established in the closed condition of the lid.

The open lever 12 may also be interlocked with the remote-controlled rod 14 even in this embodiment as described and in this case it is possible to select the operation of either lock-releasing knob from within the car room or of directly releasing the lock by means of a key 22.

Although the latch mechanism and the striker have been fixed onto the lid and the vehicle body in this embodiment, they may needless to say be respectively fixed to the vehicle body and the lid instead.

As is obvious from the description above, the latch mechanism of the open-close member for a vehicle according to the present invention has the following effect:

In a case where the lid is closed out of its open condition, the latch mechanism will not be actuated but kept in the open condition. Therefore, the lid will never be closed inadvertently, whereby accidents arising from locking any person or child into a trunk room can be prevented.

Provision of the cancel lever makes it possible to switch between the presence and absence of the mechanism used to prevent the lid from being closed when the lid is closed and consequently the latch mechanism of the invention becomes user-friendly because the presence or absence thereof is selectable according to the purpose on the part of the user.

However, the present invention is not limited to the aforementioned embodiments but may be modified in various manners within the scope of claims.

What is claimed is:

1. A latch mechanism for an open-close member of a vehicle, said latch mechanism comprising:

a base plate having a groove for introducing a striker;

a latch plate pivotally supported on said base plate and for holding said striker introduced into said groove of said base plate;

a detent lever pivotally supported on said base plate and for holding said latch plate in a latched condition;

an open lever for separating said latch plate from said striker by abutting against said detent lever;

a stopper lever pivotally supported on said base plate and for controlling pivoting of said detent lever toward said latch plate by abutting against a part of said detent lever;

an elastic member for urging and pivoting said stopper lever toward said detent lever at all times; and a reset lever pivotably supported on said base plate and having a first end and a second end, the first end mating with said stopper lever and the second end having a lock-releasing knob, wherein said reset lever is pivoted through an operation of said lock-releasing knob between (i) a first position where the pivoting of said detent lever is controlled by said stopper lever and (ii) a second position where control of the pivoting of said detent lever by said stopper lever is released.

2. A latch mechanism for an open-close member of a vehicle according to claim 1, further comprising a cancel lever pivotally supported on said base plate and for holding said stopper lever through a pivotal operation in two positions of an abutment and a non-abutment position with respect to said detent lever.

3. A latch mechanism for an open-close member of a vehicle according to claim 2, wherein said stopper lever has a retaining pawl and said cancel lever has a cam face, and wherein said stopper lever is held in the non-abutment position with respect to said detent lever when said cam face mates with said retaining pawl.

4. A latch mechanism for an open-close member of a vehicle according to claim 1, wherein said latch plate has a contact portion, and in a state that said reset lever is in the second position, said contact portion of said latch plate impinges on said reset lever so as to return said reset lever to the first position when said striker is introduced into said groove of said base plate and causes said latch plate to be pivoted.

5. A latch mechanism for an open-close member of a vehicle according to claim 4, wherein said reset lever has a flange portion which impinges said contact portion of said latch plate.

6. A latch mechanism for an open-close member of a vehicle according to claim 1, wherein said reset lever has a pin at said first end, and said stopper lever has a cam hole in which said pin is fitted, and wherein said pin moves within said cam hole when said reset lever is pivoted between said first and second positions, and pivoting of said stopper lever is interlocked with a movement of said pin.

7. A latch mechanism for an open-close member of a vehicle according to claim 1, wherein said elastic member is a torsion spring.

8. A latch mechanism for an open-close member of a vehicle according to claim 1, further comprising a turnover spring for urging said reset lever toward one of the first and second positions.

* * * * *